US010882094B2

(12) United States Patent
Kabe et al.

(10) Patent No.: US 10,882,094 B2
(45) Date of Patent: Jan. 5, 2021

(54) SPINNING FORMING METHOD

(71) Applicant: KAWASAKI JUKOGYO KABUSHIKI KAISHA, Kobe (JP)

(72) Inventors: Yoshiro Kabe, Kobe (JP); Yoshihide Imamura, Kobe (JP); Yuto Sakane, Kobe (JP); Kohei Mikami, Akashi (JP); Hayato Iwasaki, Kobe (JP); Hiroshi Kitano, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 15/302,584

(22) PCT Filed: Mar. 27, 2015

(86) PCT No.: PCT/JP2015/001784
§ 371 (c)(1),
(2) Date: Oct. 7, 2016

(87) PCT Pub. No.: WO2015/155954
PCT Pub. Date: Oct. 15, 2015

(65) Prior Publication Data

US 2017/0021405 A1 Jan. 26, 2017

(30) Foreign Application Priority Data

Apr. 11, 2014 (JP) ..... 2014-081834

(51) Int. Cl.
*B21D 22/14* (2006.01)
*B21D 22/18* (2006.01)
*B21D 37/16* (2006.01)

(52) U.S. Cl.
CPC ..... *B21D 22/14* (2013.01); *B21D 22/18* (2013.01); *B21D 37/16* (2013.01)

(58) Field of Classification Search
CPC ..... B21D 22/14; B21D 22/18; B21D 37/16; B21D 22/16; B21D 22/185; B21D 31/005; B21D 53/26; B21D 53/28
See application file for complete search history.

(56) References Cited

U.S. PATENT DOCUMENTS 3,815,395 A 6/1974 Sass
6,199,419 B1 3/2001 Shrayer et al.
2015/0202677 A1* 7/2015 Ogishi ..... B21D 22/18 72/19.1

FOREIGN PATENT DOCUMENTS

DE 4425033 A1 1/1996
DE 10156086 A1 * 6/2003 ..... B21D 22/16
(Continued)

OTHER PUBLICATIONS

Machine translation of DE10156086A1, Friese et al., pp. 1-9, translated on Sep. 11, 2018.*
(Continued)

*Primary Examiner* — Teresa M Ekiert
(74) *Attorney, Agent, or Firm* — Oliff PLC

(57) ABSTRACT

In a spinning forming method, a plate including a peripheral portion at which a ring-shaped projection is provided is used, the projection projecting in a thickness direction of the plate. Further, while rotating the plate, a transform target portion of the plate is locally heated, and a processing tool is pressed against the transform target portion to transform the plate. According to this configuration, a heat capacity of the peripheral portion of the plate can be increased. With this, when heating the vicinity of the peripheral portion of the plate, the peripheral portion can be prevented from becoming high in temperature. As a result, deformation of the peripheral portion of the plate can be suppressed.

7 Claims, 5 Drawing Sheets

(56) References Cited

FOREIGN PATENT DOCUMENTS

| | | | |
|---|---|---|---|
| JP | H11-342430 | A | 12/1999 |
| JP | 2011-218427 | A | 11/2011 |
| WO | 2014/024384 | A1 | 2/2014 |

OTHER PUBLICATIONS

Apr. 14, 2017 Office Action issued in Chinese Patent Application No. 201580009496.1.
Jun. 23, 2015 International Search Report issued in International Patent Application No. PCT/JP2015/001784.
Oct. 12, 2016 International Preliminary Report on Patentability issued in International Patent Application No. PCT/JP2015/001784.
Oct. 19, 2017 Search Report issued in European Patent Application No. 15776137.0.

* cited by examiner

SPINNING FORMING METHOD

TECHNICAL FIELD

The present invention relates to a spinning forming method for forming a plate in a desired shape while rotating the plate.

BACKGROUND ART

Conventionally known is a spinning forming device designed to transform a plate by pressing a processing tool against the plate while rotating the plate. The spinning forming device normally includes a mandrel (shaping die) attached to a rotating shaft and performs forming in such a manner that the plate is pressed against the mandrel by the processing tool.

In recent years, proposed is a spinning forming device designed to perform spinning forming while locally heating the plate. For example, as a spinning forming device for a titanium alloy, PTL 1 discloses a spinning forming device configured such that a portion of the plate which is pressed against the mandrel by a spatula (processing tool) is heated by high frequency induction heating.

CITATION LIST

Patent Literature

PTL 1: Japanese Laid-Open Patent Application Publication No. 2011-218427

SUMMARY OF INVENTION

Technical Problem

In the case of heating the plate, as a heated position of the plate approaches a peripheral portion of the plate, a release margin (conduction distance) of heat released from the heated position toward an outer side in a radial direction decreases. Therefore, when heating the vicinity of the peripheral portion of the plate, there may be a case where: not only the heated position but also the peripheral portion becomes high in temperature; and the peripheral portion decreases in stiffness by this heat and therefore deforms. Such deformation of the peripheral portion causes, for example, contact between the plate and the heater.

An object of the present invention is to provide a spinning forming method capable of suppressing deformation of a peripheral portion of a plate when heating a vicinity of the peripheral portion of the plate.

Solution to Problem

To solve the above problems, a spinning forming method of the present invention includes: using a plate including a peripheral portion at which a ring-shaped projection is provided, the projection projecting in a thickness direction of the plate; and while rotating the plate, locally heating a transform target portion of the plate and pressing a processing tool against the transform target portion to transform the plate.

According to the above configuration, a heat capacity of the peripheral portion of the plate can be increased. With this, when heating the vicinity of the peripheral portion of the plate, the peripheral portion can be prevented from becoming high in temperature. As a result, deformation of the peripheral portion of the plate can be suppressed.

For example, a formula "$0.1 \leq m \times n \leq 1$" may be satisfied, where a width of the projection is m times a thickness of the plate, and a height of the projection is n times the thickness of the plate.

Heating the transform target portion and pressing the processing tool against the transform target portion may be performed in a forming region from a forming start position to a forming end position in the plate, the forming end position being located on the projection. According to this configuration, the plate can be formed in a desired shape over an area close to an outer peripheral surface of the plate. In addition, since stiffness of the peripheral portion is secured by the projection, the forming can be performed with a high degree of accuracy even in the vicinity of the outer peripheral surface of the plate.

For example, the transform target portion of the plate may be heated by induction heating.

Heating the transform target portion of the plate may be performed by a heater including: a coil portion extending in a rotational direction of the plate and having a doubled circular-arc shape facing the plate; and a pair of lead portions each forming a step extending away from the plate between the coil portion and the lead portion. According to this configuration, even when the projection projects from the plate toward the same side as the heater, the coil portion can be positioned near the plate at an inner side of the projection.

The projection may be integrally provided at the plate. According to this configuration, by utilizing the projection, a formed product including a peripheral portion having a tubular shape can be obtained as a formed product having a final shape.

The projection may be formed separately from the plate and joined to the plate. According to this configuration, the plate itself can be reduced in cost.

Advantageous Effects of Invention

According to the present invention, the deformation of the peripheral portion of the plate can be suppressed when heating the vicinity of the peripheral portion of the plate.

DESCRIPTION OF EMBODIMENTS

Figure 1A:
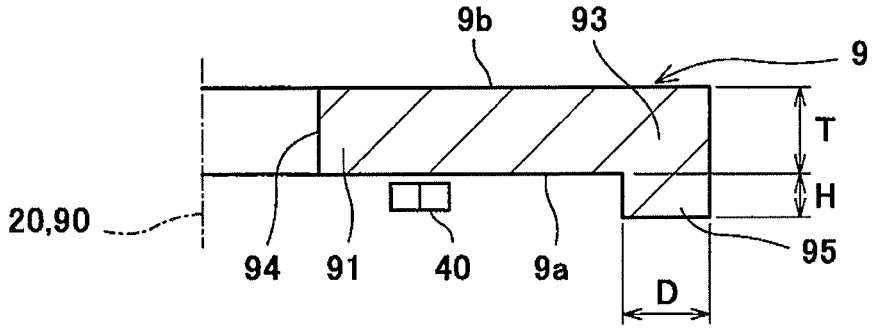
FIGS. 1A and 1B are diagrams for explaining a spinning forming method according to one embodiment of the present invention.
Figure 1B:
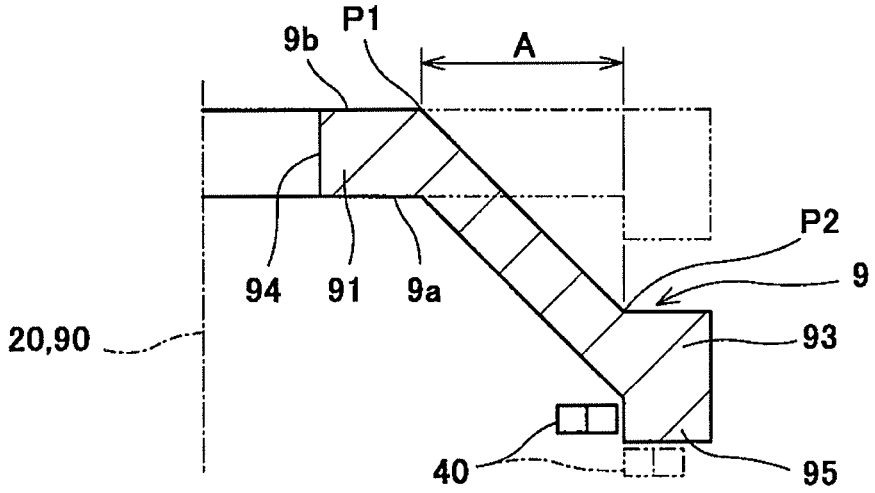

According to a spinning forming method of one embodiment of the present invention, a plate 9 shown in FIG. 1A is formed in a final shape (a shape including a tapered portion) shown in FIG. 1B. As shown in FIG. 1B, the plate 9 includes: a rear surface 9*a* facing an inner side in the final shape; and a front surface 9*b* facing an outer side in the final shape.

Figure 2:
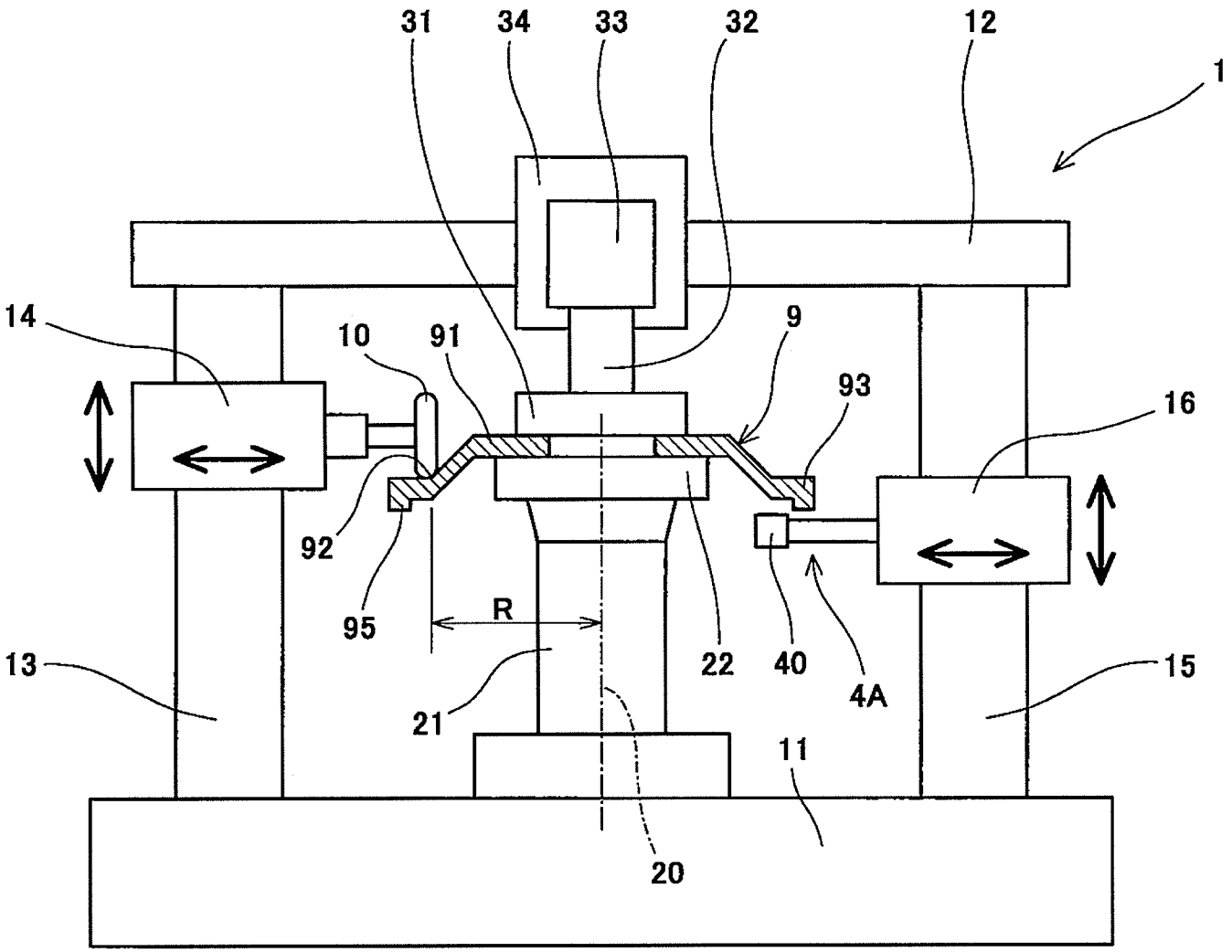
FIG. 2 is a schematic configuration diagram of a spinning forming device that executes the spinning forming method.

The spinning forming method of the present embodiment is executed by a spinning forming device 1 shown in FIG. 2. While rotating the plate, the spinning forming device 1 locally heats a transform target portion 92 of the plate 9 and presses a processing tool 10 against the transform target portion 92 to transform the plate 9.

In the present embodiment, local heating of the transform target portion 92 is performed by induction heating using a rear-side heater 4A. The rear-side heater 4A is disposed at an opposite side of the processing tool 10 across the plate 9.

The spinning forming device 1 includes: a rotating shaft 21 that rotates the plate 9; a receiving jig 22 attached to the rotating shaft 21 and supporting a central portion 91 of the plate 9; and a fixing jig 31 that sandwiches the plate 9 together with the receiving jig 22. The transform target portion 92 is a portion located away from a center axis 20 of the rotating shaft 21 by a predetermined distance R. As shown in FIGS. 1A and 1B, the center axis 20 of the rotating shaft 2 coincides with a central axis 90 of the plate 9.

As shown in FIG. 2, an axial direction of the rotating shaft 21 (i.e., a direction in which the center axis 20 extends) is a vertical direction in the present embodiment. However, the axial direction of the rotating shaft 21 may be a horizontal direction or an oblique direction. A lower portion of the rotating shaft 21 is supported by a base 11. The rotating shaft 21 is rotated by a motor, not shown.

The plate 9 is, for example, a flat circular plate. In the present embodiment, as shown in FIG. 1A, a circular opening 94 is provided at a center of the plate 9. For example, the opening 94 is used when positioning the plate 9 with respect to the receiving jig 22. It should be noted that the plate 9 does not necessarily have to include the opening 94. A material of the plate 9 is not especially limited and is, for example, a titanium alloy.

A ring-shaped projection 95 projecting in a thickness direction of the plate 9 is provided at a peripheral portion 93 of the plate 9. In the present embodiment, the projection 95 is integrally provided at the plate 9 so as to project downward from the rear surface 9*a*. However, the projection 95 may be provided at the plate 9 so as to project upward from the front surface 9*b*. Or, the projection 95 may be provided at each of the rear surface 9*a* and front surface 9*b* of the plate 9. Further, in the present embodiment, the projection 95 has a rectangular cross-sectional shape. However, the cross-sectional shape of the projection 95 is not limited to this and may be, for example, a trapezoidal shape or a semicircular shape.

The projection 95 is provided to increase a heat capacity of the peripheral portion 93 of the plate 9. It is desirable that the projection 95 be configured to satisfy a formula "$0.1 \leq m \times n \leq 1$" where m denotes a ratio of a width D of the projection 95 to a thickness T of the plate 9 ($D=m \times T$), and n denotes a ratio of a height H of the projection 95 to the thickness T of the plate 9 ($H=n \times T$). The thickness T of the plate 9 and the width D and height H of the projection 95 are sizes of the plate 9 that is not yet subjected to forming. When $m \times n$ is less than 0.1, the heat capacity of the peripheral portion 93 cannot be effectively increased. When $m \times n$ exceeds one, a material tends to be wasted, or interference between the projection 95 and its surrounding tends to occur.

As shown in FIG. 1B, a forming region A from a forming start position P1 to a forming finish position P2 in the plate 9 does not overlap the projection 95 in the present embodiment. More specifically, the forming finish position P2 and an inner side surface of the projection 95 are located on a same cylindrical plane that extends in the axial direction of the rotating shaft 21. The forming region A is a region where the heating of the transform target portion 92 and the pressing of the transform target portion 92 by the processing tool 10 are performed. The forming region A is formed in a tapered shape. However, the forming finish position P2 may be located on the projection 95, and the forming region A may partially overlap the projection 95. In this case, it is desirable that the projection 95 be provided only on the rear surface 9*a* opposite to the front surface 9*b* with which the processing tool 10 contacts.

As shown in FIG. 2, the receiving jig 22 has a size within a circle defined by the forming start position P1 (see FIG. 1B) of the plate 9. To be specific, the plate 9 is not transformed by being pressed against a radially outer side surface of the receiving jig 22. However, instead of the receiving jig 22, a mandrel including a side surface as a forming surface for the plate may be used.

The fixing jig 31 is attached to a pressurizing rod 32. The pressurizing rod 32 is rotatably supported by a supporting portion 33. The supporting portion 33 is driven by a driving portion 34 in an upward/downward direction. The driving portion 34 is attached to a frame 12 disposed above the rotating shaft 21. It should be noted that the fixing jig 31 may be omitted, and the plate 9 may be directly fixed to the receiving jig 22 by, for example, bolts.

The processing tool 10 that presses the transform target portion 92 of the plate 9 is disposed above the plate 9, and the plate 9 is formed in a downwardly opening shape that accommodates the receiving jig 22. However, the processing tool 10 may be disposed under the plate 9, and the plate 9 may be formed in an upwardly opening shape that accommodates the fixing jig 31.

The processing tool 10 is moved by a radial direction movement mechanism 14 in a radial direction of the rotating shaft 21 and is also moved by an axial direction movement mechanism 13 through the radial direction movement mechanism 14 in the axial direction of the rotating shaft 21. The axial direction movement mechanism 13 extends so as to couple the base 11 and the frame 12. The processing tool 10 is moved by the radial direction movement mechanism 14 from the forming start position P1 to the forming finish position P2 while being pressed downward by the axial direction movement mechanism 13 against the plate 9.

In the present embodiment, used as the processing tool 10 is a roller that follows the rotation of the plate 9 to rotate. However, the processing tool 10 is not limited to the roller and may be, for example, a spatula.

The rear-side heater 4A is moved by a radial direction movement mechanism 16 in the radial direction of the rotating shaft 21 and is also moved by an axial direction movement mechanism 15 through the radial direction movement mechanism 16 in the axial direction of the rotating shaft 21. The axial direction movement mechanism 15 extends so as to couple the base 11 and the frame 12.

For example, a displacement meter (not shown) is attached to the rear-side heater 4A. The displacement meter measures a distance to the transform target portion 92 of the plate 9. The rear-side heater 4A is moved in the axial direction and radial direction of the rotating shaft 21 in conjunction with the processing tool 10 such that a measured value of the displacement meter becomes constant.

The relative positions of the rear-side heater 4A and the processing tool 10 are not especially limited as long as they are located on substantially the same circumference around the center axis 20 of the rotating shaft 21. For example, the rear-side heater 4A may be separated from the processing tool 10 in a circumferential direction of the rotating shaft 21 by 180°.

Figure 3A:
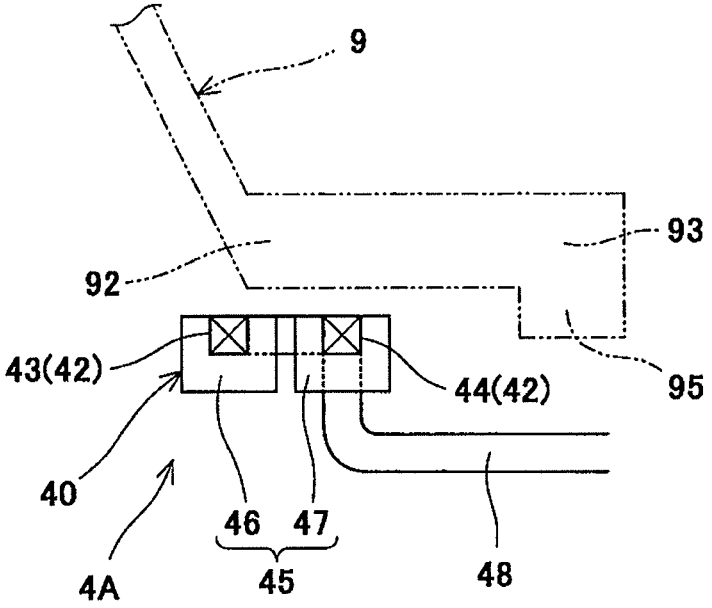
FIG. 3A is a cross-sectional view of a rear-side heater.
Figure 3B:
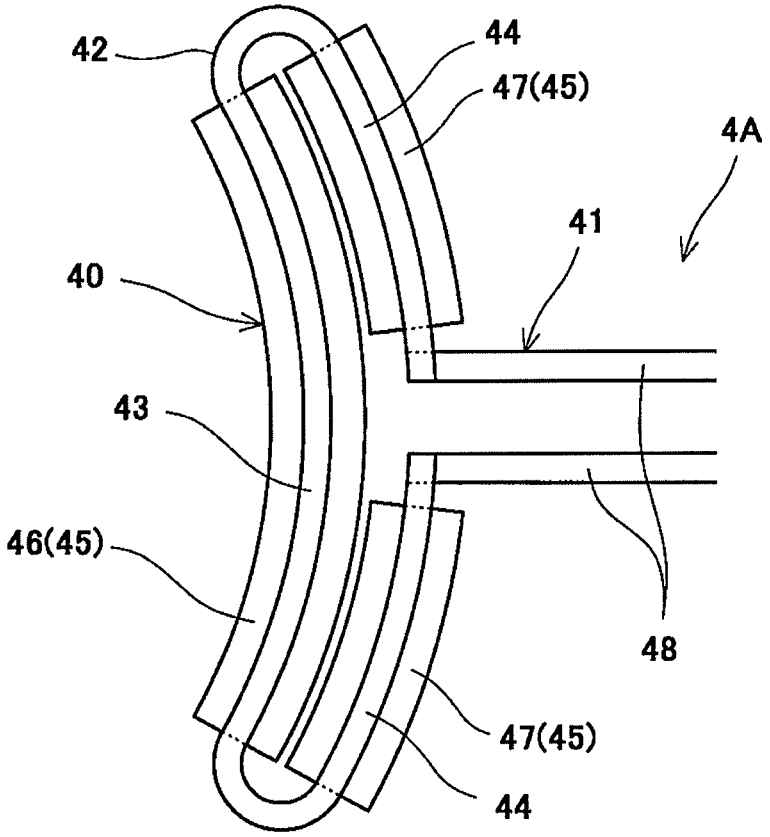
FIG. 3B is a plan view of the rear-side heater.

As shown in FIGS. 3A and 3B, the rear-side heater 4A includes an electric conducting pipe 41 and a core 45. The electric conducting pipe 41 includes a coil portion 42 and a pair of lead portions 48. The core 45 collects magnetic flux generated around the coil portion 42. The coil portion 42 and the core 45 constitute a heating head 40 facing the plate 9.

The coil portion 42 has a doubled circular-arc shape extending in a rotational direction of the plate 9 and facing the plate 8. An opening angle (angle between both end portions) of the coil portion 42 is, for example, 60° to 120°. Each of the pair of lead portions 48 forms a step extending away from the plate 9 between the coil portion 42 and the lead portion 48. More specifically, each of the lead portions 48 first extends downward from a middle of the coil portion 42 and is then bent outward in the radial direction of the rotating shaft 21.

In the present embodiment, the coil portion 42 includes one inner circular-arc portion 43 and two outer circular-arc portions 44 to which the respective lead portions 48 are connected. However, the coil portion 42 may include two inner circular-arc portions 43 to which the respective lead portions 48 are connected and one outer circular-arc portion 44. Further, when the projection 95 is provided only on the front surface 9*b* of the plate 9, the lead portions 48 may linearly extend outward in the radial direction of the rotating shaft 21 from the middle of the coil portion 42.

The core 45 is constituted by one inner peripheral piece 46 and two outer peripheral pieces 47. The inner peripheral piece 46 covers the inner circular-arc portion 43 of the coil portion 42 from an opposite side of the plate 9. The outer peripheral pieces 47 cover the outer circular-arc portions 44 of the coil portion 42 from the opposite side of the plate 9.

A cooling liquid flows in the electric conducting pipe 41. Further, an alternating voltage is applied to the electric conducting pipe 41. A frequency of the alternating voltage is not especially limited but is desirably a high frequency of 5 k to 400 kHz. To be specific, the induction heating performed by the rear-side heater 4A is desirably high frequency induction heating.

It is desirable that the rear-side heater 4A be moved such that the heating head 40 is located immediately under the transform target portion 92. However, after the transform target portion 92 approaches the forming finish position P2, the heating head 40 may be maintained at an inner side of the projection 95 as shown by solid lines in FIG. 1B or may be moved to a position under the projection 95 as shown by two-dot chain lines in FIG. 1B.

As described above, since the plate 9 including the peripheral portion 93 at which the projection 95 is provided is used in the spinning forming method of the present embodiment, the heat capacity of the peripheral portion 93 can be increased. With this, when heating the vicinity of the peripheral portion 93 of the plate 9, the peripheral portion 93 can be prevented from becoming high in temperature. As a result, deformation of the peripheral portion 93 of the plate 9 can be suppressed.

When the forming finish position P2 is located on the projection 95, and the forming region A partially overlaps the projection 95, the plate 9 can be formed in a desired shape over an area close to an outer peripheral surface of the plate 9. In addition, since stiffness of the peripheral portion 93 is secured by the projection 95, the forming can be performed with a high degree of accuracy even in the vicinity of the outer peripheral surface of the plate 9. In a case where the forming finish position P2 is located on the projection 95, as shown by the two-dot chain lines in FIG. 1B, the heating head 40 of the rear-side heater 4A is moved to a position under the projection 95 when forming the peripheral portion 93, and the peripheral portion 93 is heated together with the projection 95.

In the present embodiment, the projection 95 is integrally provided at the plate 9. Therefore, as shown in FIG. 1B, by utilizing the projection 95, a formed product including a peripheral portion having a tubular shape can be obtained as a formed product having a final shape.

In the present embodiment, the pair of lead portions 48 of the rear-side heater 4A are configured such that the step extending away from the plate 9 is formed between the coil portion 42 and each lead portion 48. Therefore, even when the projection 95 projects from the plate 9 toward the same side as the heater, the coil portion 42 can be positioned near the plate 9 at an inner side of the projection 95.

Other Embodiments

The present invention is not limited to the above embodiment, and various modifications may be made within the scope of the present invention.

Figure 4:
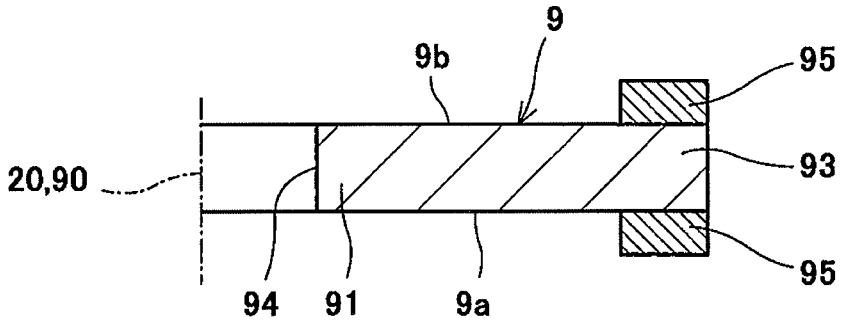
FIG. 4 is a cross-sectional view of a plate of Modified Example.

For example, the projection 95 provided on the rear surface 9*a* and/or the front surface 9*b* of the plate 9 does not necessarily have to be integrally provided at the plate 9. For example, as shown in FIG. 4, the projection 95 may be formed separately from the plate 9 and joined to the plate 9. According to this configuration, the plate 9 itself can be reduced in cost.

Figure 5:
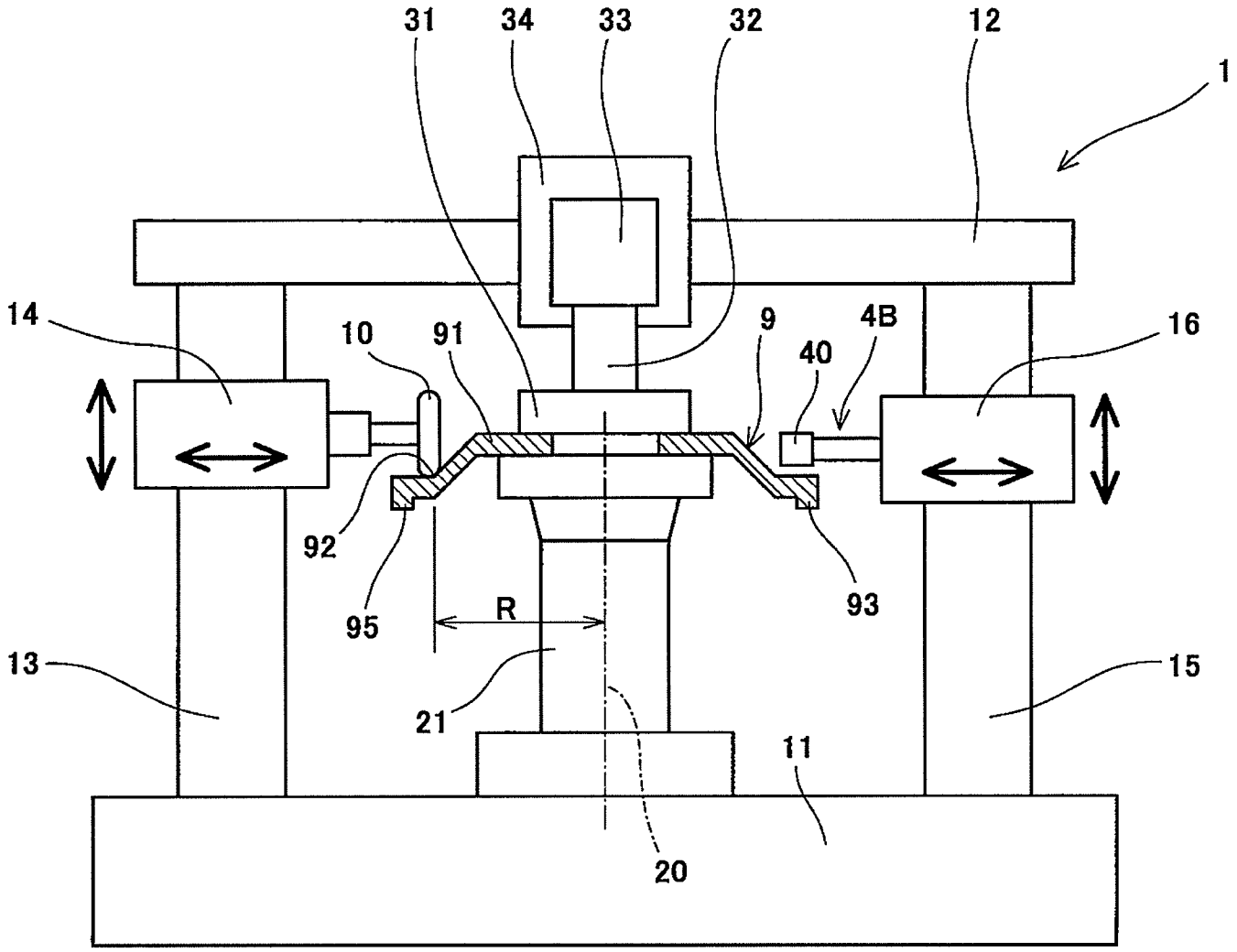
FIG. 5 is a schematic configuration diagram of an alternative spinning forming device.

The local heating of the transform target portion 92 may be performed by induction heating using a front-side heater 4B shown in FIG. 5. The front-side heater 4B is disposed at the same side as the processing tool 10 relative to the plate 9 and configured in the same way as the rear-side heater 4A. To be specific, the front-side heater 4B includes the heating head 40 explained in the above embodiment.

The local heating of the transform target portion 92 may be performed by using both the rear-side heater 4A and the front-side heater 4B. In this case, to avoid interference with the plate 9 and the projection 95, the rear-side heater 4A and the front-side heater 4B may be moved by the different radial direction movement mechanisms 16 and the different axial direction movement mechanisms 15. Further, the local heating of the transform target portion 92 may be performed by, for example, a gas burner.

INDUSTRIAL APPLICABILITY

The present invention is useful when performing spinning forming of plates made of various materials.

REFERENCE SIGNS LIST

10 processing tool
4A, 4B heater
42 coil portion
48 lead portion
9 plate
92 transform target portion
93 peripheral portion
95 projection

The invention claimed is:

1. A spinning forming method comprising:

using a plate including a central portion and a peripheral portion, the central portion being supported by a receiving jig, the peripheral portion being not directly supported by the receiving jig, and a ring-shaped projection being provided at the peripheral portion and projecting toward one side in a thickness direction of the plate; and while rotating the plate, locally heating a transform target portion of the plate and forming a forming region of the plate into a tapered shape by pressing a processing tool that is arranged radially at or inward from the projection against the transform target portion from an opposite side of the one side, the forming region spreads from a forming start position to a forming end position, the forming start position is located away from the receiving jig, and the forming end position is located at a radially outer side of the forming start position, and during the pressing, the forming region of the plate is not directly supported by the receiving jig.

2. The spinning forming method according to claim 1, wherein a formula "$0.1 \leq m \times n \leq 1$" is satisfied, where a width of the projection is m times a thickness of the plate, and a height of the projection is n times the thickness of the plate.

3. The spinning forming method according to claim 1, wherein the forming end position is located on the projection.

4. The spinning forming method according to claim 1, wherein the transform target portion of the plate is heated by induction heating.

5. The spinning forming method according to claim 4, wherein heating the transform target portion of the plate is performed by a heater including: a coil portion extending in a rotational direction of the plate and having a doubled circular-arc shape facing the plate; and a pair of lead portions each forming a step extending away from the plate between the coil portion and the lead portion.

6. The spinning forming method according to claim 1, wherein the projection is integrally provided on the plate.

7. The spinning forming method according to claim 1, wherein the projection is separate from the plate and prior to the using step, joining the projection to the plate.

* * * * *